US005735522A

United States Patent [19]

Sausa

[11] Patent Number: 5,735,522

[45] Date of Patent: Apr. 7, 1998

[54] QUOTE AND YEAR TRIVIA QUESTION GAME

[76] Inventor: Damien Sausa, 71-33 66 Rd., Middle Village, N.Y. 11379

[21] Appl. No.: 842,221

[22] Filed: Apr. 24, 1997

[51] Int. Cl.[6] ..... A63F 3/00

[52] U.S. Cl. ..... 273/249; 273/431

[58] Field of Search ..... 273/248, 249, 273/243, 429, 430, 431

[56] References Cited

U.S. PATENT DOCUMENTS 5,066,016 11/1991 O'Neill ..... 273/431 X
5,121,928 6/1992 Salerno-Sonneberg ..... 273/431 X
5,295,834 3/1994 Saunders ..... 273/249 X
5,308,079 5/1994 Dreznick et al. ..... 273/249
5,544,891 8/1996 Gibson et al. ..... 273/431 X
5,645,279 7/1997 Reutlinger ..... 273/249
5,660,389 8/1997 Fredea, III ..... 273/431 X

*Primary Examiner*—William E. Stoll

[57] ABSTRACT

A quote and year trivia question game including a game board, die, a plurality of game pieces and a plurality of cards. Each of the cards has a front face with a plurality of quotes and questions relating to various subjects printed thereon. On a rear face of each card is the origin and answer of the quote and questions, respectively. The game is played by each player rolling the dice and moving an associated game piece along the game board as governed by whether or not the player guesses the correct origin or answer.

4 Claims, 2 Drawing Sheets

QUOTE AND YEAR TRIVIA QUESTION GAME

BACKGROUND OF THE INVENTION

1. Field of the Invention

The present invention relates to a quote and year trivia question game and more particularly pertains to guessing the origin of quotes of famous people.

2. Description of the Prior Art

The use of trivia question games is known in the prior art. More specifically, trivia question games heretofore devised and utilized for the purpose of answering questions in the game-like manner are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 4,900,031 to Wohl; U.S. Pat. No. 4,940,239 to Tuttle; U.S. Pat. No. Des. 262,125 to Carroll et al.; U.S. Pat. No. 5,048,842 to Proctor; U.S. Pat. No. 5,066,016 to O'Neill; and U.S. Pat. No. 4,201,388 to Cantelon.

In this respect, the quote and year trivia question game according to the present invention substantially departs from the conventional concepts and designs of the prior art, and in so doing provides an apparatus primarily developed for the purpose of guessing the origin of quotes of famous people.

Therefore, it can be appreciated that there exists a continuing need for a new and improved quote and year trivia question game which can be used for guessing the origin of quotes of famous people. In this regard, the present invention substantially fulfills this need.

SUMMARY OF THE INVENTION

In view of the foregoing disadvantages inherent in the known types of trivia question games now present in the prior art, the present invention provides an improved quote and year trivia question game. As such, the general purpose of the present invention, which will be described subsequently in greater detail, is to provide a new and improved quote and year trivia question game which has all the advantages of the prior art and none of the disadvantages.

To attain this, the present invention essentially comprises game board with a square configuration having a top face, a bottom face, and a periphery formed therebetween. As shown in FIG. 1, the top face has a trail with a first end situated adjacent the periphery and a second end situated at a center of the top face. As shown in the Figures, the trail has a generally spiral configuration and includes a plurality of blocks situated end to end. Such blocks include a first set of blocks each having a first indicia printed therein representative of a first subject, a second set of blocks each having a second indicia printed therein representative of a second subject, a third set of blocks each having a third indicia printed therein representative of a third subject, and a fourth set of blocks each having a fourth indicia printed therein representative of a fourth subject. The blocks are situated along the trail in a predetermined repetitive order. As shown in FIG. 2, a pair of die are provided each having a cubical configuration with a unique number situated on each side thereof. Also included is a plurality of game pieces each including bottom extent with a semi-spherical configuration having a planar bottom surface and a arcuate top surface. A post is provided with a first end integrally coupled to the top surface of the bottom extent and extended upwardly therefrom. The post of each game piece further has a bulb integrally formed on a second end thereof. With reference now to FIGS. 4 & 5, a plurality of cards are included each with a rectangular configuration having a front face, a rear face, and a periphery including a top edge, a bottom edge, and a pair of side edges. The front face of each card has a first row situated a first distance from the top edge of the card having the first indicia printed adjacent one of the side edges of the card with the first row of the front face further having a first quote printed thereon relating to the first subject, a second row situated a second distance greater than the first distance from the top edge of the card and having the second indicia printed adjacent one of the side edges of the card with the second row of the front face further having a first question printed thereon relating to the second subject, a third row situated a third distance greater than the second distance from the top edge of the card and having the third indicia printed adjacent one of the side edges of the card with the third row of the front face further having a second question printed thereon relating to the third subject, and a fourth row situated a fourth distance greater than the third distance from the top edge of the card and having the fourth indicia printed adjacent one of the side edges of the card with the fourth row of the front face further having a second quote printed thereon relating to the fourth subject. With particular attention now to FIG. 5, each card has a rear face each having a first row situated the first distance from the top edge of the card and having the first indicia printed adjacent one of the side edges of the card with the first row of the front face further having a first name printed thereon indicating the origin of the first quote, a second row situated the second distance from the top edge of the card and having the second indicia printed adjacent one of the side edges of the card with the second row of the front face further having a first numerical date answer printed thereon indicating the date answer of the first question, a third row situated the third distance from the top edge of the card and having the third indicia printed adjacent one of the side edges of the card with the third row of the front face further having a second numerical date answer printed thereon indicating the date answer of the second question, and a fourth row situated a fourth distance from the top edge of the card and having the fourth indicia printed adjacent one of the side edges of the card with the fourth row of the front face further having a second name printed thereon indicating the origin of the second quote.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved quote and year trivia question game which has all the advantages of the prior art trivia question games and none of the disadvantages.

It is another object of the present invention to provide a new and improved quote and year trivia question game which may be easily and efficiently manufactured and marketed.

It is a further object of the present invention to provide a new and improved quote and year trivia question game which is of a durable and reliable construction.

An even further object of the present invention is to provide a new and improved quote and year trivia question game which is susceptible of a low cost of manufacture with regard to both materials and labor, and which accordingly is then susceptible of low prices of sale to the consuming public, thereby making such quote and year trivia question game economically available to the buying public.

Still yet another object of the present invention is to provide a new and improved quote and year trivia question game which provides in the apparatuses and methods of the prior art some of the advantages thereof, while simultaneously overcoming some of the disadvantages normally associated therewith.

Still another object of the present invention is to guess the origin of quotes of famous people.

Lastly, it is an object of the present invention to provide a new and improved quote and year trivia question game including a game board, die, a plurality of game pieces and a plurality of cards. Each of the cards has a front face with a plurality of quotes and questions relating to various subjects printed thereon. On a rear face of each card is the origin and answer of the quote and questions, respectively. The game is played by each player rolling the die and moving an associated game piece along the game board as governed by whether or not the player guesses the correct origin or answer.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
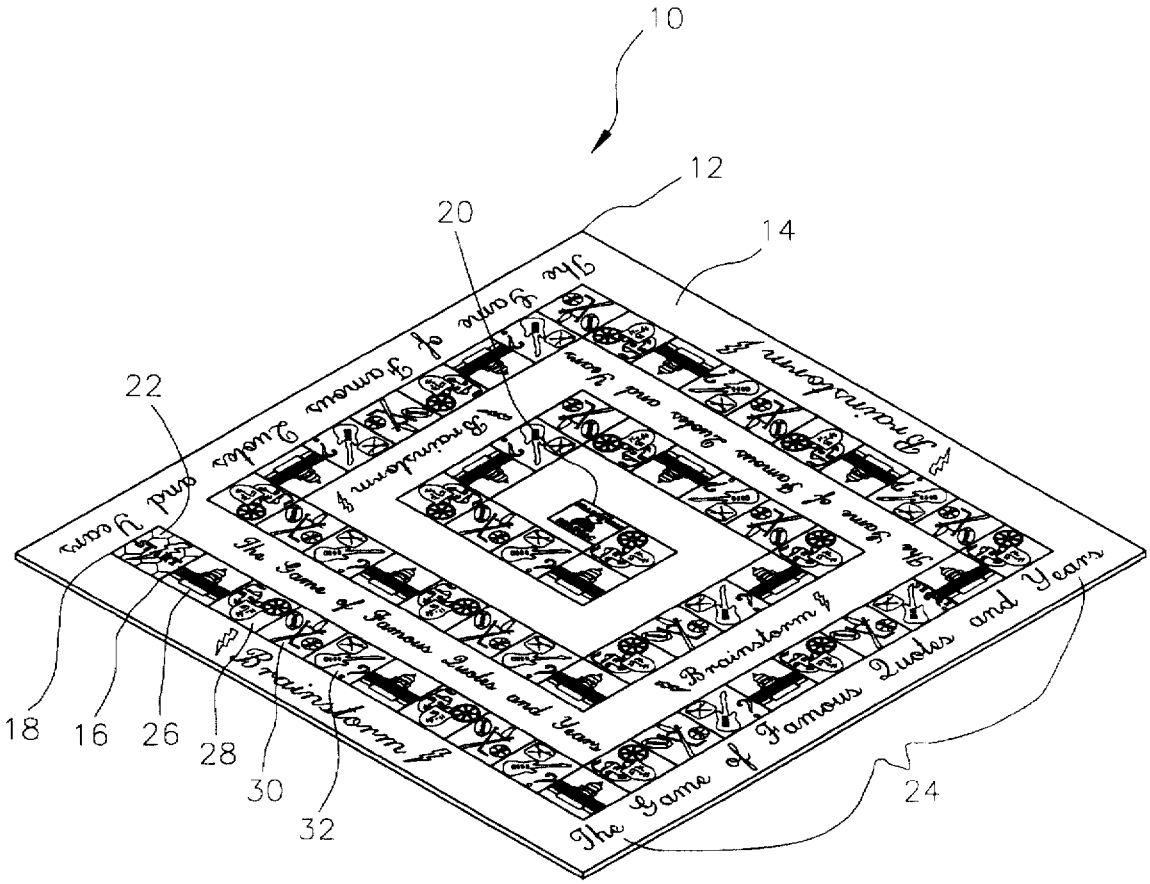
FIG. 1 is a perspective illustration of the preferred embodiment of the quote and year trivia question game constructed in accordance with the principles of the present invention.

With reference now to the drawings, and in particular to FIG. 1 thereof, a new and improved quote and year trivia question game embodying the principles and concepts of the present invention and generally designated by the reference numeral 10 will be described.

The present invention, the new and improved quote and year trivia question game, is comprised of a plurality of components. Such components in their broadest context include a game board, a pair of die, playing pieces, a plurality of playing cards, and a card containment box. Such components are individually configured and correlated with respect to each other so as to attain the desired objective.

More specifically, it will be noted that the system 10 of the present invention includes a game board 12 with a square configuration having a top face 14, a bottom face, and a periphery formed therebetween. As shown in FIG. 1, the top face has a trail 16 with a first end 18 situated adjacent the periphery and a second end 20 situated at a center of the top face. As shown in the Figures, the trail has a generally spiral configuration and includes a plurality of blocks 22 situated end to end. In the preferred embodiment, the spiral is composed of a plurality of linear segments 24 of blocks that are each parallel with a corresponding side edge of the game board. Each segment is spaced from an adjacent segment. Such blocks include a first set of blocks each having a first indicia 26 printed therein representative of a first subject with the subject being history, a second set of blocks each having a second indicia 28 printed therein representative of a second subject with the second subject being the arts, a third set of blocks each having a third indicia 30 printed therein representative of a third subject with the third subject being sports, and a fourth set of blocks each having a fourth indicia 32 printed therein representative of a fourth subject with the fourth subject being music. The blocks are situated along the trail in a predetermined repetitive order. Such order ensures that each set of blocks is always resident adjacent the same two sets of blocks. As shown in FIG. 1, each indicia is comprised of a picture indicative of the associated subject. Preferably, a start block and an end block are included.

Figure 2:
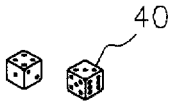
FIG. 2 is a perspective view of the die of the present invention.
Figure 3:
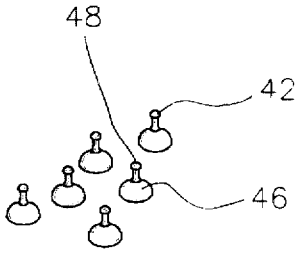
FIG. 3 is a perspective view of the playing pieces of the present invention.

As shown in FIG. 2, a pair of die 40 are provided each having a cubical configuration with a unique number situated on each side thereof.

Also provided is a plurality of game pieces 42 each including bottom extent 46 with a semi-spherical configuration having a planar bottom surface and an arcuate top surface. A post 48 is provided with a first end integrally coupled to the top surface of the bottom extent and extended upwardly therefrom. The post of each game piece further has a bulb integrally formed on a second end thereof.

Figure 4:
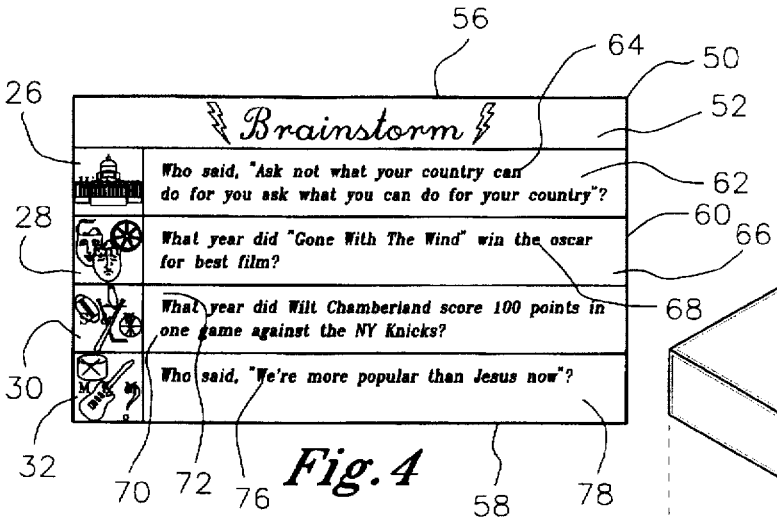
FIG. 4 is an illustration of the top face of one of the cards of the present invention.
Figure 5:
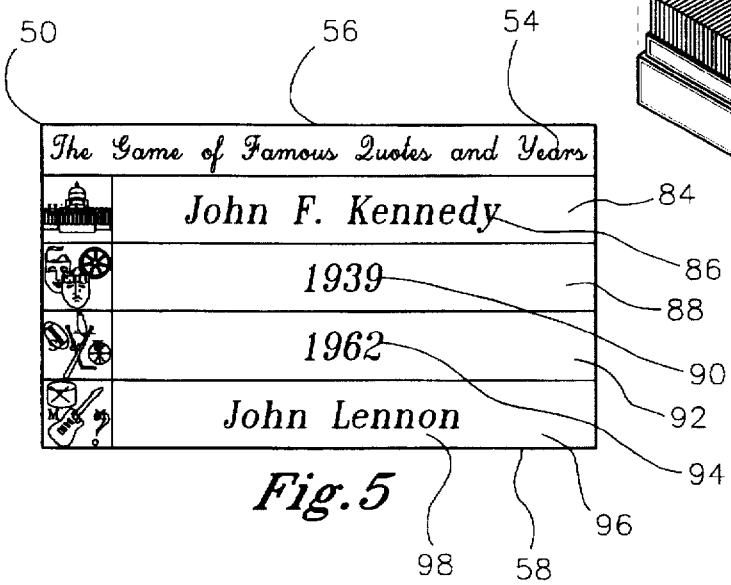
FIG. 5 is an illustration of the bottom face of one of the cards of the present invention.
Figure 6:
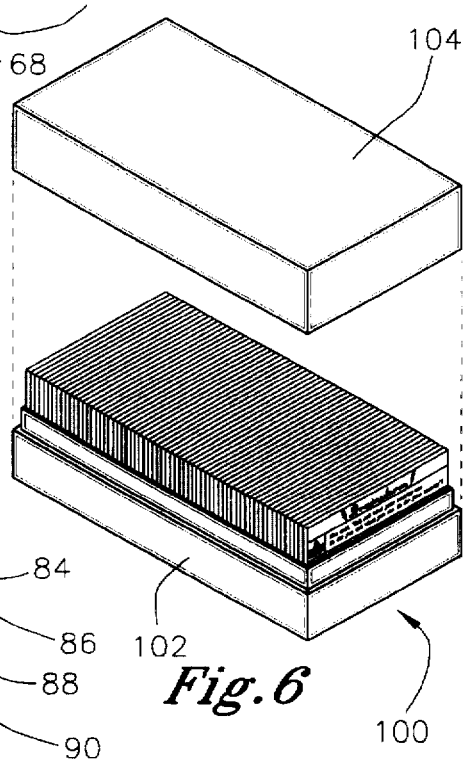
FIG. 6 is a perspective of the card containment box in the open orientation thereof.

With reference now to FIGS. 4 & 5, a plurality of cards 50 are included each with a rectangular configuration having a front face 52, a rear face 54, and a periphery including a top edge 56, a bottom edge 58, and a pair of side edges 60.

The front face of each card has a first row 62 situated a first distance from the top edge of the card having the first indicia printed adjacent one of the side edges of the card. Also, the first row of the front face further has a first quote 64 printed thereon relating to the first subject, history. A second row 66 of the front face is situated a second distance greater than the first distance from the top edge of the card and has the second indicia printed adjacent one of the side edges of the card. The second row of the front face further has a first question 68 printed thereon relating to the second subject, the arts. Also provided is a third row 70 situated a third distance greater than the second distance from the top edge of the card and having the third indicia printed adjacent one of the side edges of the card. The third row of the front face further has a second question 72 printed thereon relating to the third subject, sports. Lastly, a fourth row 74 is situated a fourth distance greater than the third distance from the top edge of the card and having the fourth indicia printed adjacent one of the side edges of the card with the fourth row of the front face further having a second quote 76 printed thereon relating to the fourth subject. It should be noted that accompanying the first and second quote is the statement "Who said . . . ?" Further, accompanying the first and second question is the phrases "What year"?

With particular attention now to FIG. 5, each card also has a rear face each having a first row 84 situated the first distance from the top edge of the card and having the first indicia printed adjacent one of the side edges of the card. The first row of the front face further has a first name 86 printed thereon indicating the origin of the first quote. A second row 88 is situated the second distance from the top edge of the card and has the second indicia printed adjacent one of the side edges of the card. The second row of the front face has a first numerical date answer 90 printed thereon indicating the date answer of the first question. A third row 92 is situated the third distance from the top edge of the card and has the third indicia printed adjacent one of the side edges of the card with the third row of the front face further having a second numerical date answer 94 printed thereon indicating the date answer of the second question. Next, a fourth row 96 is situated a fourth distance from the top edge of the card and has the fourth indicia printed adjacent one of the side edges of the card. The fourth row of the front face further includes a second name 98 printed thereon indicating the origin of the second quote.

Further included is a card containment box 100 having a lower portion 102 with a rectilinear configuration including a bottom face and a periphery integrally coupled thereto and extended upwardly therefrom defining a top opening. The periphery of the box has an inset upper edge. The card containment box further includes an upper portion 104 with a top face and a periphery integrally coupled thereto and extended downwardly therefrom for being removably coupled to the inset lip of the lower portion of the box. When not in use, the plurality of cards may be stored therein.

The method of playing the game of the present invention is first afforded by providing the structure set forth hereinabove. During play, each player takes a turn rolling the die. In each turn, the present player traverses a game piece a number of blocks equal to the number indicated by the rolled die. Upon the arrival at the appropriate block, one of the players other than the one whose turn it is picks one of the plurality of cards. At this time, the player who picks the card, reads the quote in the row of the front face having an indicia that matches the indicia printed on the block on which the game piece resides. Next, the present player guesses who first cited the quote if the block on which the playing piece resides corresponds with the first and fourth indicia. If the playing piece resides on a block that corresponds with the second and third indicia, the present player guesses the correct date answer to the question. It should be noted that in an alternate embodiment, which row asks a question or the origin of a quote is random. Upon guessing the origin of the quote or answering the question correctly, the present player is permitted to take another turn. If, however, the guess is wrong, the present player is not permitted to take another turn. Finally, a winner is defined as the person who reaches the second end of the trail first.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved quote and year trivia question game comprising, in combination:

a game board with a square configuration having a top face, a bottom face, and a periphery formed therebetween, the top face having a trail with a first end situated adjacent the periphery and a second end situated at a center of the top face wherein the trail has a generally spiral configuration, the trail including a plurality of blocks situated end to end with the blocks including a first set of blocks each having a first indicia printed therein representative of a first subject, a second set of blocks each having a second indicia printed therein representative of a second subject, a third set of blocks each having a third indicia printed therein representative of a third subject, and a fourth set of blocks each having a fourth indicia printed therein representative of a fourth subject, the blocks situated along the trail in a predetermined repetitive order;

a pair of dice each having a cubical configuration with a unique number situated on each side thereof;

a plurality of game pieces each including a bottom extent with a semi-spherical configuration having a planar bottom surface and an arcuate top surface and a post with a first end integrally coupled to the top surface of the bottom extent and extended upwardly therefrom, the post of each game piece further having a bulb integrally formed on a second end thereof;

a plurality of cards each with a rectangular configuration having a front face, a rear face, and a periphery including a top edge, a bottom edge, and a pair of side edges, the front face of each card having a first row situated a first distance from the top edge of the card and having a first indicia printed adjacent one of the side edges of the card with the first row of the front face further having a first quote printed thereon relating to the first subject, a second row situated a second distance greater than the first distance from the top edge of the card and having a second indicia printed adjacent one of the side edges of the card with the second row of the front face further having a first question printed thereon relating to the second subject, a third row situated a third distance greater than the second distance from the top edge of the card and having a third indicia printed adjacent one of the side edges of the card with the third row of the front face further having a second question printed thereon relating to the third subject, and a fourth row situated a fourth distance greater than the third distance from the top edge of the card and having a fourth indicia printed adjacent one of the side edges of the card with the fourth row of the front face further having a second quote printed thereon relating to the fourth subject, each card having a rear face each having a first row situated the first distance from the top edge of the card and having a first indicia printed adjacent one of the side edges of the card with the first row of the rear face further having a first name printed thereon indicating the origin of the first quote, a second row situated the second distance greater than the first distance from the top edge of the card and having a second indicia printed adjacent one of the side edges of the card with the second row of the rear face further having a first numerical date answer printed thereon indicating the date answer of the first question, a third row situated the third distance from the top edge of the card and having a third indicia printed adjacent one of the side edges of the card with the third row of the rear face further having a second numerical date answer printed thereon indicating the date answer of the second question, and a fourth row situated the fourth distance from the top edge of the card and having a fourth indicia printed adjacent one of the side edges of the card with the fourth row of the rear face further having a second name printed thereon indicating the origin of the second quote; and a card containment box having a lower portion with a rectilinear configuration including a bottom face and a periphery integrally coupled thereto and extended upwardly therefrom defining a top opening, the periphery of the box having an inset upper edge, the card containment box further having an upper portion with a top face and a periphery integrally coupled thereto and extended downwardly therefrom for being removably coupled to the inset lip of the lower portion of the box, whereby the plurality of cards may be stored therein when not in use.

2. A quote and year trivia question game comprising:

a game board with a square configuration having a top face, a bottom face, and a periphery formed therebetween, the top face having a trail with a first end and a second end, the trail including a plurality of blocks situated end to end with the blocks including a first set of blocks each having a first indicia printed therein representative of a first subject, a second set of blocks each having a second indicia printed therein representative of a second subject, a third set of blocks each having a third indicia printed therein representative of a third subject, and a fourth set of blocks each having a fourth indicia printed therein representative of a fourth subject, the blocks situated along the trail in a predetermined repetitive order;

a pair of dice;

a plurality of game pieces; and a plurality of cards each with a rectangular configuration having a front face, a rear face, and a periphery including a top edge, a bottom edge, and a pair of side edges, the front face of each card having a first row situated a first distance from the top edge of the card and having a first indicia printed adjacent one of the side edges of the card with the first row of the front face further having a first quote printed thereon relating to the first subject, a second row situated a second distance greater than the first distance from the top edge of the card and having a second indicia printed adjacent one of the side edges of the card with the second row of the front face further having a first question printed thereon relating to the second subject, a third row situated a third distance greater than the second distance from the top edge of the card and having a third indicia printed adjacent one of the side edges of the card with the third row of the front face further having a second question printed thereon relating to the third subject, and a fourth row situated a fourth distance greater than the third distance from the top edge of the card and having a fourth indicia printed adjacent one of the side edges of the card with the fourth row of the front face further having a second quote printed thereon relating to the fourth subject, each card having a rear face each having a first row situated the first distance from the top edge of the card and having a first indicia printed adjacent one of the side edges of the card with the first row of the rear face further having a first name printed thereon indicating the origin of the first quote, a second row situated the second distance from the top edge of the card and having a second indicia printed adjacent one of the side edges of the card with the second row of the rear face further having a first numerical date answer printed thereon indicating the date answer of the first question, a third row situated the third distance from the top edge of the card and having a third indicia printed adjacent one of the .side edges of the card with the third row of the rear face further having a second numerical date answer printed thereon indicating the date answer of the second question, and a fourth row situated the fourth distance from the top edge of the card and having a fourth indicia printed adjacent one of the side edges of the card with the fourth row of the rear face further having a second name printed thereon indicating the origin of the second quote.

3. A quote and year trivia question game as set forth in claim 2 and further including a card containment box having a lower portion with a rectilinear configuration including a bottom face and a periphery integrally coupled thereto and extended upwardly therefrom defining a top opening, the periphery of the box having an inset upper edge, the card containment box further having an upper portion with a top face and a periphery integrally coupled thereto and extended downwardly therefrom for being removably coupled to the inset lip of the lower portion of the box, whereby the plurality of cards may be stored therein when not in use.

4. A method of playing a quotation game comprising the steps of:

providing a game board with a square configuration having a top face, a bottom face, and a periphery formed therebetween, the top face having a trail with a first end situated adjacent the periphery and a second end situated at a center of the top face wherein the trail has a generally spiral configuration, the trail including a plurality of blocks situated end to end with the blocks including a first set of blocks each having a first indicia printed therein representative of a first subject, a second set of blocks each having a second indicia printed therein representative of a second subject, a third set of blocks each having a third indicia printed therein representative of a third subject, and a fourth set of blocks each having a fourth indicia printed therein representative of a fourth subject, the blocks situated along the trail in a predetermined repetitive order;

providing a pair of dice each having a cubical configuration with a unique number situated on each side thereof;

providing a plurality of game pieces each including bottom extent with a semi-spherical configuration having a planar bottom surface and a arcuate top surface and a post with a first end integrally coupled to the top surface of the bottom extent and extended upwardly therefrom, the post of each game piece further having a bulb integrally formed on a second end thereof;

providing a plurality of cards each with a rectangular configuration having a front face, a rear face, and a periphery including a top edge, a bottom edge, and a pair of side edges, the front face of each card having a first row situated a first distance from the top edge of the card and having the first indicia printed adjacent one of the side edges of the card with the first row of the front face further having a first quote printed thereon relating to the first subject, a second row situated a second distance greater than the first distance from the top edge of the card and having the second indicia printed adjacent one of the side edges of the card with the second row of the front face further having a first question printed thereon relating to the second subject, a third row situated a third distance greater than the second distance from the top edge of the card and having the third indicia printed adjacent one of the side edges of the card with the third row of the front face further having a second question printed thereon relating to the third subject, and a fourth row situated a fourth distance greater than the third distance from the top edge of the card and having the fourth indicia printed adjacent one of the side edges of the card with the fourth row of the front face further having a second quote printed thereon relating to the fourth subject, each card having a rear face each having a first row situated the first distance from the top edge of the card and having the first indicia printed adjacent one of the side edges of the card with the first row of the rear face further having a first name printed thereon indicating the origin of the first quote, a second row situated the second distance from the top edge of the card and having the second indicia printed adjacent one of the side edges of the card with the second row of the rear face further having a first numerical date answer printed thereon indicating the date answer of the first question, a third row situated the third distance from the top edge of the card and having the third indicia printed adjacent one of the side edges of the card with the third row of the rear face further having a second numerical date answer printed thereon indicating the date answer of the second question, and a fourth row situated the fourth distance from the top edge of the card and having the fourth indicia printed adjacent one of the side edges of the card with the fourth row of the rear face further having a second name printed thereon indicating the origin of the second quote;

providing a card containment box having a lower portion with a rectilinear configuration including a bottom face and a periphery integrally coupled thereto and extended upwardly therefrom defining a top opening, the periphery of the box having an inset upper edge, the card containment box further having an upper portion with a top face and a periphery integrally coupled thereto and extended downwardly therefrom for being removably coupled to the inset lip of the lower portion of the box, whereby the plurality of cards may be stored therein when not in use;

rolling the die;

traversing a game piece a number of blocks equal to the number indicated by the rolled die;

picking one of the plurality of cards;

reading in the row of the front face having an indicia that matches the indicia printed on the block on which the game piece resides;

guessing who was the origin of the quote if the quote corresponds with the first and fourth indicia;

guessing the date answer if the quote corresponds with the second and third indicia;

taking another turn if the guess is correct;

not taking another turn if the guess is wrong; and declaring a winner as a person who reaches the second end of the trail first.

* * * * *